United States Patent [19]

Breen et al.

[11] Patent Number: 5,016,367

[45] Date of Patent: May 21, 1991

[54] IRONING BOARD HAVING SWINGABLE EXTENSIONS AND A DETACHABLE SUSPENDED TABLE, FOR IRONING TROUSERS, SHIRTS, AND LARGE ITEMS

[76] Inventors: Christine O. Breen, 8 Belleview Blvd., Apt. 508, Belleair, Fla. 34616; Joseph M. Breen, 60 Cove St., East Norwalk, Conn. 06855

[21] Appl. No.: 536,315

[22] Filed: Jun. 11, 1990

[51] Int. Cl.[5] ..... D06F 81/12; D06F 81/02; D06F 81/04

[52] U.S. Cl. ..... 38/135; 38/136; 38/107; 38/112; 38/104; 38/DIG. 3; 38/103; 38/DIG. 2; 38/DIG. 1

[58] Field of Search ..... 38/DIG. 1, DIG. 2, DIG. 3, 38/10, 20, 21, 103, 106, 111, 112, 135, 136, 138, 139; 108/6, 29, 118, 120, 149; 223/52, 52.5, 57, 68, 72

[56] References Cited

U.S. PATENT DOCUMENTS

| | | | |
|---|---|---|---|
| 476,332 | 6/1892 | Tubbs | 38/139 X |
| 584,505 | 6/1897 | Harrigan | 38/135 |
| 1,173,508 | 2/1916 | Heartwell | 38/135 X |
| 1,755,617 | 4/1930 | Wallerstein | 38/135 |
| 1,770,802 | 7/1930 | Petty | 38/135 |
| 2,523,425 | 9/1950 | Gargaglione | 38/112 X |
| 2,662,319 | 12/1953 | Hortman | 38/DIG. 3 X |
| 2,888,759 | 6/1959 | Vennen | 38/135 |
| 2,908,984 | 10/1959 | Lantz | 38/DIG. 3 X |
| 4,809,450 | 3/1989 | Hochstrasser et al. | 38/135 X |
| 4,910,894 | 3/1990 | Vartan | 38/135 X |

*Primary Examiner*—Werner H. Schroeder
*Assistant Examiner*—Ismael Izaguirre

[57] ABSTRACT

An ironing board that includes a main board and two swingable board extensions retractable attached to the main board. The main board comprises a relatively wide section and a comparatively narrow section forming a single planar ironing surface. The narrow section is adapted to telescopically receive a trouser leg, which can be rotated so that all trouser leg areas can be ironed. The swingable board extensions are adapted to receive the sleeve areas of shirts and blouses.

14 Claims, 2 Drawing Sheets

IRONING BOARD HAVING SWINGABLE EXTENSIONS AND A DETACHABLE SUSPENDED TABLE, FOR IRONING TROUSERS, SHIRTS, AND LARGE ITEMS

BACKGROUND AND SUMMARY OF THE INVENTION

This relates to ironing boards, especially to ironing boards having a number of different ironing board sections adapted for ironing different garments or different areas of a garment or fabric item.

The ironing board of this invention comprises a main board and two board extensions. The main board comprises a relatively wide section having two parallel side edges spaced apart about twenty inches so as to provide a relatively large ironing area therebetween. The main board further includes a relatively narrow elongated section extending from one end of the wide section of the board. This narrow board section is adapted to have the leg of a trouser slipped thereover for ironing the trouser leg material. The trouser leg can periodically be rotated around the narrow board section for ironing different areas of the trouser leg.

At the areas where the narrow section of the board joins the wide section of the board two angular shoulder edges are formed. A blouse or shirt can be slipped over the board so that shoulder areas of the garment are on the shoulder edges of the board. The garment conforms generally to the board configuration so that shoulder areas of the garment can be ironed flat on the board surface.

The ironing board has two swingably mounted extensions that can be moved between retracted positions extending alongside the narrow section of the main board and extended positions projecting outwardly beyond the side edges of the main board. When the board extensions are in their extended positions their upper faces are in contiguous planar alignment with the upper face of the main board. Shirts and blouses can be positioned with their sleeve areas telescoped over (around) the board extensions. Extensive areas of the blouse or shirt can be ironed in one continuous operation without interruptions for repositioning or reforming the garment.

In order to facilitate the ironing of very large fabric items, e.g. sheet or curtains, the board includes a supplemental table that is adapted to be detachably suspended from a side edge of the main board so as to effectively augment the ironing area. The supplemental table can be readily detached from the main area of the board when it is desired to iron smaller items.

DESCRIPTION OF A PREFERRED EMBODIMENT OF THE INVENTION

Figure 1:
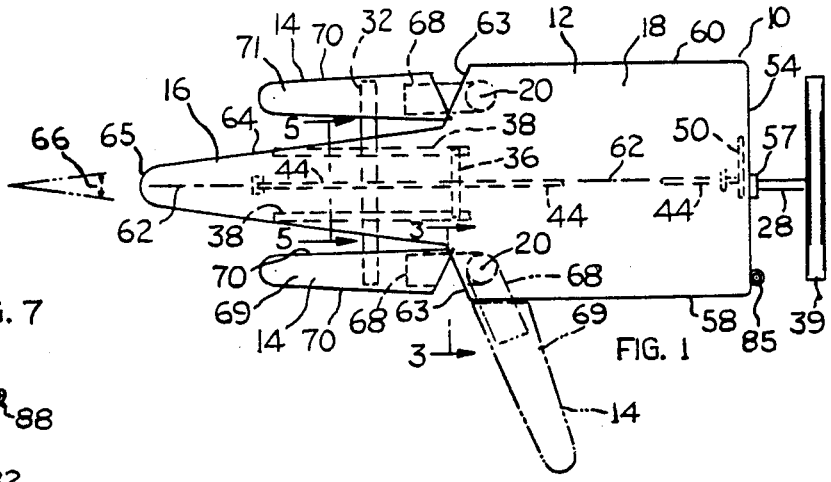
FIG. 1 is a top plan view of an ironing board constructed according to the teachings of our invention.
Figure 2:
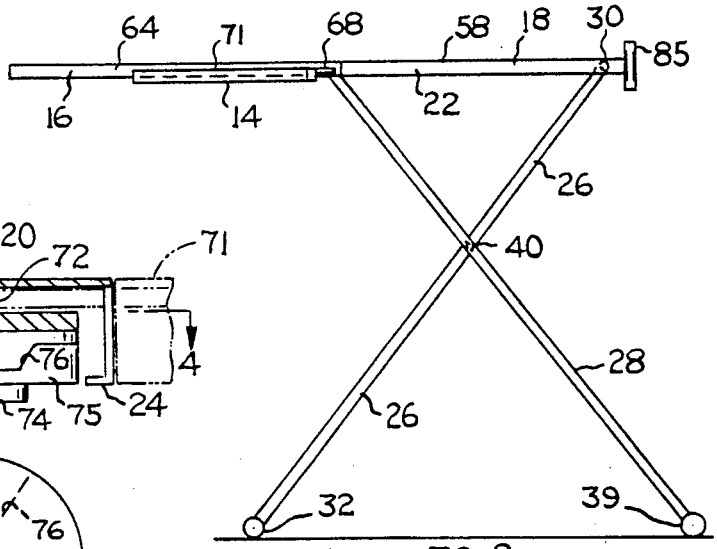
FIG. 2 is a side view of the FIG. 1 ironing board.

FIGS. 1 and 2 show an ironing board 10 that includes a main board 12 and two swingable board extensions 14. FIG. 1 shows one of the extensions 14 in two alternate positions of adjustment. As shown in full lines, extension 14 is retraced to a position lying alongside a narrow section 16 of main board 12. Extension 14 is also shown in a dashed line position projecting outwardly from a relatively wide section 18 of the main board. Each extension 14 is mounted for swinging motion around a vertical pivot axis 20 through an arcuate distance of approximately one hundred ten degrees.

Figure 5:
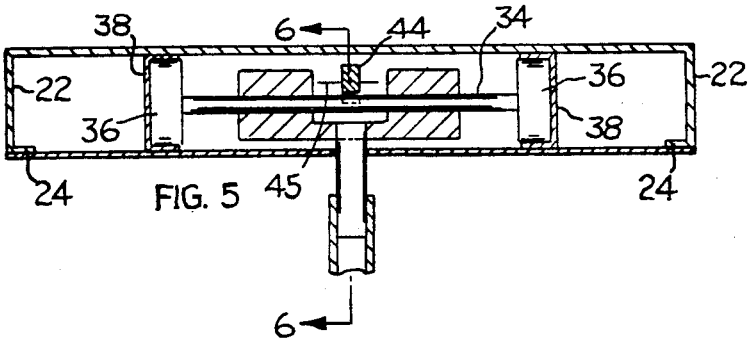
FIG. 5 is a transverse sectional view taken on line 5—5 in FIG. 1.

Main board 12 comprises a flat sheet metal structure having a downwardly-extending flange 22 extending therearound, except for certain edge areas where clearance is required to permit swinging motions of the two swingable board extensions 14. An inturned rim wall 24 can be formed on the lower end of flange 22, as shown in FIG. 5. The space circumscribed by flange 22 can be used to mount upper end areas of leg structures 26 and 28.

Leg structure 26 has its upper end pivotably connected to the underside of main board 12, as at 30. The lower end of leg structure 26 comprises a transversely-extending tube 32 having rubber cups on its opposite ends. Leg structure 28 has its upper end attached to a transversely-extending shaft 34 (FIG. 5) that carries rollers 36 at its opposite ends. These rollers can move back and forth in tracks 38 attached to the underside of the ironing board. The lower end of leg 28 is attached to a transverse tube 39.

Leg structures 26 and 28 are interconnected at intermediate points therealong by a pivot 40. The arrangement is such that the leg assembly can be collapsed against the undersurface of the ironing board or assume various inclined positions, as necessary to maintain the ironing board in different positions of vertical adjustment.

Figure 6:
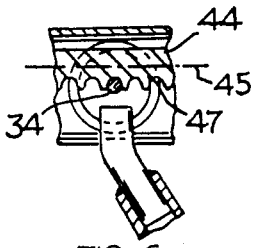
FIG. 6 is a fragmentary sectional view taken on line 6—6 in FIG. 5.
Figure 9:
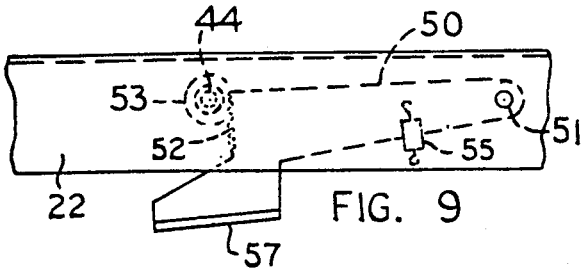
FIG. 9 is a fragmentary right end view of the FIG. 1 ironing board illustrating a latch mechanism that can be used to hold the board in different positions of vertical adjustment.

With the illustrated leg arrangement it is necessary to anchor the upper end of leg structure 28 at selected locations along tracks 38. FIGS. 5, 6 and 9 illustrate one latch means that can be used to immobilize shaft 34, thereby anchoring the upper end of leg structure 28. The latch structure comprises an elongated bar 44 extending midway between tracks 38. This bar is mounted for pivotal motion around a longitudinal axis 45 so that the bar can assume a horizontal prone position above shaft 34 or a vertical position (FIGS. 5 and 6) extending downwardly across the shaft. When the bar is in its vertical position notches 47 in the bar interact with shaft 34 to immobilize it, i.e. prevent the shaft from movement along the underside of the ironing board.

FIG. 9 illustrates a manual means for moving bar 44 from its vertical position to its prone position. A manually-actuable lever 50 is swingable around pivot 51 to rotate bar 44. Gear segment 52 rotates a gear 53 carried on the right end of bar 44 to rotate the bar. A tension spring 55 returns lever 50 and bar 44 to their initial positions when manually-actuable surface 57 of the lever is released. A manual squeeze force on lever surface 57 is used when it is desired to adjust the ironing board height. Release of the squeeze force causes bar 44 to latch the leg assembly in it adjusted position.

Referring more particularly to FIG. 1, main board 12 has a right end edge 54 extending between straight side edges 58 and 60. Edges 58 and 60 are located equidistant from a longitudinal centerline 62 of the board. Two shoulder edges 63 extend angularly from edges 58 and 60 toward centerline 62 at acute angles of approximately forty five degrees. Typically, edges 58 and 60 are spaced apart about twenty inches; shoulder edges 63 are spaced from edge 54 by a distance of about twenty four inches. The board space circumscribed by edges 54, 58, 60, and 63 constitutes a relatively wide section 18 of main board 12.

A relatively narrow section 16 of the main board is defined by two slightly convergent side edges 64 connected to a rounded (arcuate) end edge 65. Edges 64 converge at an included angle 66 that measures approximately fifteen degrees. Narrow board section 16 has a length of about twenty five inches (to the points where side edges 64 meet shoulder edges 63). Narrow board section 16 is about half as wide (at its widest point) as wide section 18.

Each swingable extension 14 comprises a flat metal (steel) bar 68 extending from the pivot axis 20 into a sheet metal ironing surface element 69 that may be constructed with edge flanges and inturned rim walls similar to flanges 22 and rim walls 24 on main board 12. Each extension 14 has two relatively long side edges 70 spaced relatively close together, so as to form an elongated ironing surface 71 (measured in the direction of side edges 70). Typically the length of each extension 14 is about twenty inches, measured from pivot axis 20. The width of each extension is about six inches.

Figure 3:
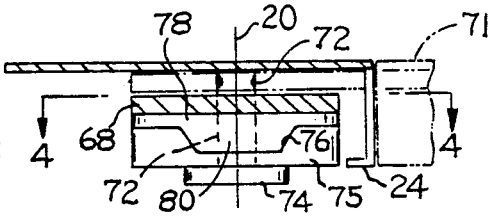
FIG. 3 is an enlarged fragmentary sectional view taken on line 3—3 in FIG. 1.
Figure 4:
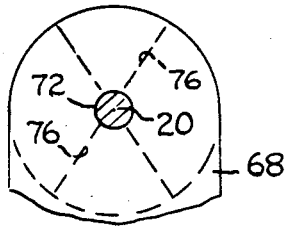
FIG. 4 is a fragmentary view taken on line 4—4 in FIG. 3.

Each pivot is defined by a vertical shaft (pin) 72, shown in some detail in FIG. 3. The upper end of the shaft is welded or otherwise secured to the underface of main board 10 in near proximity to shoulder edge 63. An enlarged head 74 on the lower end shaft of 72 carries a circular cam disk 75. Two radial recesses 76 are formed in the upper surface of disk 75. Another circular cam disk 78 is affixed to the lower face of bar 68. Two radially-extending cam lugs 80 extend downwardly from disk 78.

When ironing board extension 14 is in its retracted position (full lines in FIG. 1) cam lugs 80 fit within recesses 76 in disk 75, such that the upper face of ironing element 69 is located below the plane of the ironing surface on main board 12. As extension 14 is swung out toward its extended position (dashed lines in FIG. 1) lugs 80 slide up out of recesses 76, thereby causing ironing surface 71 on the extension to be in contiguous planar alignment with the ironing surface on main board 12, when the extension is in its extended position.

Figure 7:
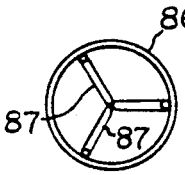
FIG. 7 is a top plan view of an iron holder that can be used on the ironing board of FIG. 1.
Figure 8:
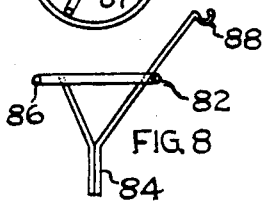
FIG. 8 is a side elevational view of the iron holder shown in FIG. 7.

To enhance the usefulness of the ironing board, an iron-holder device may be attached to the board. The holder device comprises a foraminous basket structure 82 (FIGS. 7 and 8) having a vertical stem 84. The stem is adapted to fit into a vertical socket (steel tube) 85 suitably attached to the main board 12. Basket structure 82 can be formed by an annular circular wire ring 86 and three radial rods 87. One of the rods can be extended upwardly beyond the plane of ring 86 to form a cord-support hook 88. The lower ends of rods 87 may e welded together to form vertical stem 84.

Electrical power can be supplied to the iron via an extension cord having a female plug mounted on right edge 54 of main board 10. Cutouts can be formed in flange 22 to mount the extension cord plug. The iron electrical cord will have a male plug on one end thereof adapted to mate with the female plug attached to edge 54 of the ironing board.

Figure 10:
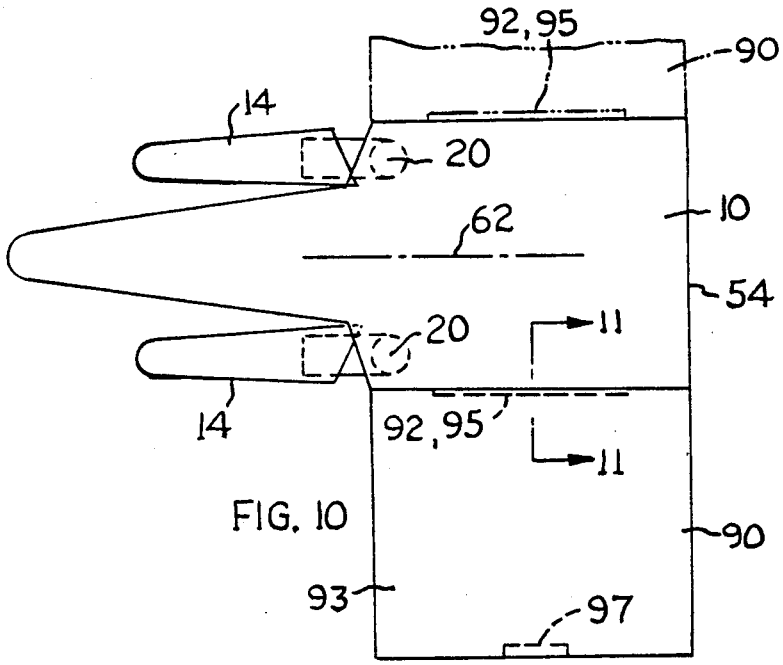
FIG. 10 is a top plan view taken in the same direction as FIG. 1, but showing a supplemental table attached to the main ironing board.
Figure 11:
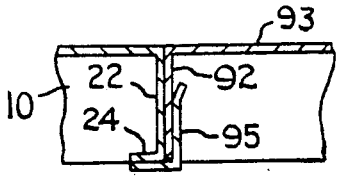
FIG. 11 is an enlarged fragmentary sectional view taken on line 11—11 in FIG. 10.

FIGS. 10 and 11 show features of a supplemental table 90 adapted to be detachably suspended from a side edge 58 or 60 of main board 12 to augment the effective ironing area surface. Table 90 has a depending flange 92 extending along one of its side edges.

The adjacent side edge of main board 12 an upwardly opening slot formed by a vertical wall 95 spaced a slight distance from flange 22.

Table 90 is attached to the ironing board by manipulating table 90 so that its depending flange 92 fits into the slot formed by wall 95. At its outboard edge, table 90 carries a foldable (swingable) support leg 97. In its installed position table 90 has the upper surface of main panel 93 in contiguous planar alignment with the ironing surface on main board 10. Leg 97 is an adjustable length structure so that panel 93 can assume a horizontal position in accordance with different adjusted heights of board 10.

If necessary two tables 90 can be attached to opposite side edges of main board 12. In many cases only one such supplemental table will be needed.

It will be noted from FIG. 1 that narrow section 16 of main board 12 is somewhat wider than each swingable extension 14. Narrow section 6 is adapted to telescopically receive therearound one leg of a trouser for ironing (pressing) purposes. The narrow section 16 is long enough to support a major portion of the trouser leg. By rotating the trouser leg around board centerline 62 it is possible to iron the complete trouser surface.

When extensions 14 are in their extended positions they are adapted to telescopically receive thereon the sleeve portions of shirts and blouses. The sleeves can be rotated periodically around the extension 14 axis to cover the front and back areas of the respective garment sleeve. Each shoulder edge 63 is angled to the associated extension 14 at approximately the same angle as the angle between a garments shoulder and upper arm. The board 12 area adjacent shoulder edge 63 can support the shoulder area of a garment while the sleeve is being ironed, thereby facilitating the simultaneous ironing of the garment sleeves and shoulder areas. When extension 14 are in their extended positions their left side edges 70 (FIG. 1) are in linear alignment with the associated shoulder edge 63.

Main board 12 has a width of about twenty inches (distance between side edges 58 and 60). The board width is greater then the width of conventional ironing boards, such that main board 12 can accommodate relatively large fabric items (e.g. sheets and curtains) table 90 can be attached to main board 12 to augment the ironing surface area.

The drawings show one specific form that the invention can take. It will be appreciated that the invention can be practiced in other forms.

We claim:

1. An ironing board comprising a main board and two board extensions;

said main board comprising a first relatively wide section and a second relatively narrow section, said wide and narrow sections having a common longitudinal centerline;

said relatively wide section of the main board having two parallel side edges spaced equidistantly from said longitudinal centerline, a first end edge connecting said side edges, and two shoulder edges extending from said side edges partway toward the longitudinal centerline;

said relatively narrow section of the main board comprising two slightly convergent side edges extending from said shoulder edges away from the wide section of the board, and a second end edge connecting said slightly convergent side edges;

each board extension having two relatively long side edges spaced relatively close together so that the board extension is elongated in the direction of the side edges, pivot means mounting each said extension for swinging motion around a vertical axis on the main board in near proximity to one of the shoulder edges; each board extension having a retracted position extending parallel to the main board centerline, and an extended position projecting laterally away form the main board centerline.

2. The ironing board of claim 1, wherein said main board has a flat upper face, and each board extension has a flat upper face; each said pivot means having a lifter means therewith so that when the associated board extension is being moved to the extended position the upper face of the extension will be elevated to the plane of the main board upper face, and when the board extension is being moved to the retracted position the upper face of the extension will be lowered below the plane of the main board upper face.

3. The ironing board of claim 2, wherein each said lifter means comprises a first cam disk carried by the main board and a second cam disk carried by the respective board extension directly above the first cam disk.

4. The ironing board of claim 3, wherein each said second cam disk has two radially extending recesses therein, and each said first cam disk has two radially extending cam lugs fitting within said recesses when the board extension is in the retracted position.

5. The ironing board of claim 1, wherein said narrow section of the main board is adapted to receive therearound a trouser leg.

6. The ironing board of claim 1, wherein the two board extensions are adapted to receive therearound sleeve sections of shirts and blouses when the board extensions are in the extended positions.

7. The ironing board of claim 1, wherein each board extension swings through an arc of approximately one hundred ten degrees when moving between the retracted and extended positions.

8. The ironing board of claim 1, wherein said main board has an upper face, and each board extension has an upper face is contiguous to the upper face of the main board when the respective board extension is in the extended position.

9. The ironing board of claim 1, and further comprising a supplemental table adapted to be detachably suspended from a designated side edge of the main board to augment the effective ironing area.

10. The ironing board of claim 9, wherein said designated side edge of the main board and the supplemental table have interfitting tracks extending therealong, whereby the supplemental table is attached to the main board by sliding the two tracks longitudinally, one within the other.

11. The ironing board of claim 1, wherein the relatively narrow section of the main board is about one half as wide as the relatively wide section; said relatively narrow section of the main board having a sufficient length as to permit a trouser leg to be inserted thereon for supporting a major portion of the trouser leg length.

12. The ironing board of claim 1, wherein said shoulder edges extend angularly from the side edges of the wide section of the main board at approximately forty five degrees; and the side edges of the relatively narrow section of the main board converge toward one another at approximately twelve degrees.

13. The ironing board of claim 1, wherein each board extension is about one half as wide as the narrow section of the main board.

14. The ironing board of claim 13, wherein each board extension projects from the main board a lesser distance than the length of the relatively narrow section of the main board.

* * * * *